United States Patent [19]

Brubaker et al.

[11] Patent Number: 4,857,019

[45] Date of Patent: Aug. 15, 1989

[54] TERMINAL PIN WITH S-SHAPED COMPLAINT PORTION

[75] Inventors: Weldon L. Brubaker, San Clemente, Calif.; Frederick J. Gierut, Tinley Park, Ill.; James T. Kowalkowski, Maple Park, Ill.; Francesco Liburdi, Naperville, Ill.

[73] Assignee: Molex Incorporated, Lisle, Ill.

[21] Appl. No.: 161,696

[22] Filed: Feb. 29, 1988

[51] Int. Cl.[4] ..... H01R 13/415

[52] U.S. Cl. ..... 439/751; 29/874; 439/84

[58] Field of Search ..... 439/82, 84, 758; 29/874

[56] References Cited

U.S. PATENT DOCUMENTS

| | | | |
|---|---|---|---|
| 4,188,715 | 2/1980 | Ammon et al. | 439/751 X |
| 4,586,778 | 5/1986 | Walter et al. | 439/751 X |
| 4,691,979 | 9/1987 | Manska | 439/82 |
| 4,746,301 | 5/1988 | Key | 439/751 X |
| 4,758,187 | 7/1988 | Gublhör | 439/84 X |

FOREIGN PATENT DOCUMENTS

| | | | |
|---|---|---|---|
| 152769 | 8/1985 | European Pat. Off. | 439/84 |

OTHER PUBLICATIONS

Key, Edward H., "Development of a New Drawn-Wire Compliant Pin", Twentieth Annual Connectors and Interconnection Technology Symposium, May 1988, Section: Connection Technology pp. 38–41.

Goel, Ram. "An Analysis of Press-Fit Technology". AMP Incorporated. Electronic Components Conference, Atlanta, GA, May 11–13, 1981.

*Primary Examiner*—Eugene F. Desmond

*Attorney, Agent, or Firm*—Louis A. Hecht; Stephen Z. Weiss

[57] ABSTRACT

An electrical terminal pin with a compliant portion adapted to be inserted into a plated-through hole of a circuit board. The compliant portion has a generally S-shaped cross-section with a width which gradually increases from a first axial end toward at least the middle of the axial length of the contact section. The pin has a mating portion joining the compliant portion for connection to another circuit element. Stiffening means are formed on one side of the compliant portion extending from the juncture with the mating portion to prevent breaking of the mating portion from the compliant portion when a transverse force is applied to the mating portion. The compliant pin is mass produced by using a strip of material having a generally uniform thickness throughout. The material is stamped in a given configuration and formed at successive stations to produce the S-shaped cross sectional compliant portion.

15 Claims, 4 Drawing Sheets

TERMINAL PIN WITH S-SHAPED COMPLIANT PORTION

BACKGROUND OF THE INVENTION

1. Field of the Invention

This invention relates to electrical terminal pins having a compliant portion adapted to be inserted into a plated-through hole in a circuit board or the like.

2. Brief Description of the Prior Art

Terminal pins with compliant sections or portions (sometimes called press-fit pins) have been known in the art for over thirty years. Compliant pins are design to be inserted into a plated-through hole in a printed circuit board. The pin generally includes a mating portion adapted to contact an electrically conductive element and a compliant portion extending from the mating portion and adapted to make electrical contact with conductive material defining the interior surface of the plated-through hole.

Generally speaking, the following characteristics are desirable in a compliant pin:

1. Soldering is unnecessary for high reliability applications.

2. The pins should be cyclable, i.e., the pins should be able to withstand repeated insertions and withdrawals from the plated-through hole. This allows any defective connection with the board to be easily repaired.

3. If there is any damage during the insertion, it should only occur to the pin and not the printed circuit board or the conductive material lining the hole.

4. Elastic strain energy should be largely stored in the compliant portion of the pin.

5. Pins should be able to be used over a wide range of hole sizes. This would eliminate the need for different thicknesses of the plating material formed in the hole.

6. Relatively lower insertion forces should be provided so that mass insertion is feasible.

7. If there is a permanent set as between the compliant portion and the plated-through hole, the smaller set should occur to the hole. This would allow for lower local stresses and thinner printed circuit boards.

8. The insertion force of the pin should be as nearly equal to the push out or retention force as possible.

9. The largest possible area of the compliant portion should engage the interior of the plated-through hole with the largest possible normal force.

10. Once fully inserted into a plated-through hole, the top or mating portion of the pin should be resistant to breakage when it is bent or twisted.

11. The pin should be easily manufactured, preferrably using a flat blank with the same general material thickness.

The various compliant pin designs now on the market are effective to accomplish one or more of the stated objectives listed above. However, as in many design alternatives, the increase in performance with respect to one feature may often result in a decrease in performance with respect to another feature.

It has been found that the cross-section of the compliant portion which offers the best of all of the above features is a generally S-shaped cross-section. Examples of pins or terminals of this type are disclosed in U.S. Pat. No. 3,907,400, U.S. Pat. No. 4,415,220 and Edward H. Key, Electronic Design, "Development of a New Drawn-Wire Compliant Pin", 20th Annual Connectors & Interconnection Technology Symposium, Philadelphia, Pennsylvania, Oct. 19–21, 1987 (the "Key Article").

U.S. Pat. No. 3,907,400 discloses a compliant type post which is adapted to be inserted through a printed circuit board hole. The use of this post in a plated-through hole is not disclosed. The purpose of the post is to have a wire wrap on one side to connect to another component (e.g., another wire wrap) on the other side of the printed circuit board.

U.S. Pat. No. 4,415,220 discloses an S-shaped compliant portion that gradually decreases in diameter from a fully developed section through the transition section ending with an eliptical cross section (see FIGS. 3–6). The fully developed section is of a constant width. Because of the constant width, insertion may cause plastic deformation affecting the normal force generated against the interior of the plated-through hole.

The Key Article also discloses an S-shaped compliant protion whose fully developed section is of constant width and which suffers from the same draw back of undue plastic deformation. Also disclosed is a manufacturing process which produces the pin from drawn wire. This is a relatively inefficient means of mass producing pins of this type.

The deficiencies of the prior art devices fall generally into three different categories:

1. Because of the constant width of the compliant portion there is a plastic deformation which occurs during the insertion process. This phenomenon is best described in FIG. 5 on page 4 of Ram Goel, AMP Incorporated, "An Analysis of Press-Fit Technology", Electronic Components' Conference, Atlanta, Georgia, May 11–13, 1981 (the "Goel Article"). In the Goel Article, it is shown that the middle of the compliant portion of most compliant pins are permanently and plastically deformed inwardly during insertion. As a result, the middle of the compliant portion, which should exert the highest normal force against the interior of the plated-through hole, does not generate high enough forces while still maintaining the necessary compliancy.

2. Many applications for a compliant pin require that it be able to withstand a certain amount of bending and/or twisting after inserted into the plated-through hole. Very often bending and/or twisting the mating portion of the pin results in the breakage of the pin immediately above the level of the printed circuit board. None of the prior art references addresses this problem.

3. It is very important that whatever pin design that is used be easily manufacturable. None of the S-shaped compliant pins of the prior art disclose a mass producable design.

SUMMARY OF THE INVENTION

It is, therefore, a principal object of the present invention to provide an electrical terminal pin with a compliant portion having a larger contact area and larger normal force pressing against the interior of the plated-through hole after insertion therein. To this end, there is provided a generally elongated electrical terminal pin adapted to be inserted into a plated-through hole in a circuit board, said pin including a mating portion adapted to contact an electrically conductive element and a compliant portion extending from said mating portion adapted to make electrical contact with conductive plating material defining the interior surface of said plated-through hole, said compliant portion including, in the axial direction, a transition section tapering from a first axial end to a fully developed contact section defining the axial extent of contact with the interior surface of the plated-through hole, said compliant portion further including, in the lateral direction, a generally S-shaped cross-section, the improvement in said compliant portion comprising:

said S-shaped contact section having a width that gradually increases from the transition section towards at least the middle of the axial length of the contact section.

It is another object of the present invention to provide an electrical terminal pin with increased resistance to damage caused by bending and/or twisting. To this end, there is provided a generally elongated electrical terminal pin adapted to be inserted into a hole in a circuit board, said pin including a mating portion adapted to contact an electrically conductive element and a hole engaging portion extending from said mating portion adapted to be received within said hole, the thickness of the material defining the mating portion being equal to or greater than the thickness of the material defining the hole engaging portion, the improvement in said pin comprising:

stiffening means formed on one side of the hole engaging portion extending from the juncture with the mating portion to prevent breaking of the mating portion from the hole engaging portion when a transverse force is applied to the mating portion causing bending of the mating portion relative to the hole engaging portion.

Still another object of the present invention is to provide an electrical terminal pin of the type described that is easily mass produced. To this end, there is provided a method of manufacturing spaced-apart, parallel, elongated electrical terminal pins, each pin including a mating portion joining an S-shaped compliant portion, said method comprising the steps of:

providing an elongate strip of material having a width equal to or greater than the length of the in and a first uniform thickness defined between oppositely facing first and second surfaces equal to the thickness required for the mating portion; stamping the strip transversely along the length to form a plurality of parallel, spaced-apart terminal blanks;

stamping the blank to form a section at the location of the compliant portion equal to the axial length thereof including two oppositely extending, generally tapered trapezoidal wings; and forming the wings into a generally S-shaped cross-sectional compliant portion.

DESCRIPTION OF THE PREFERRED EMBODIMENT

Figure 1:
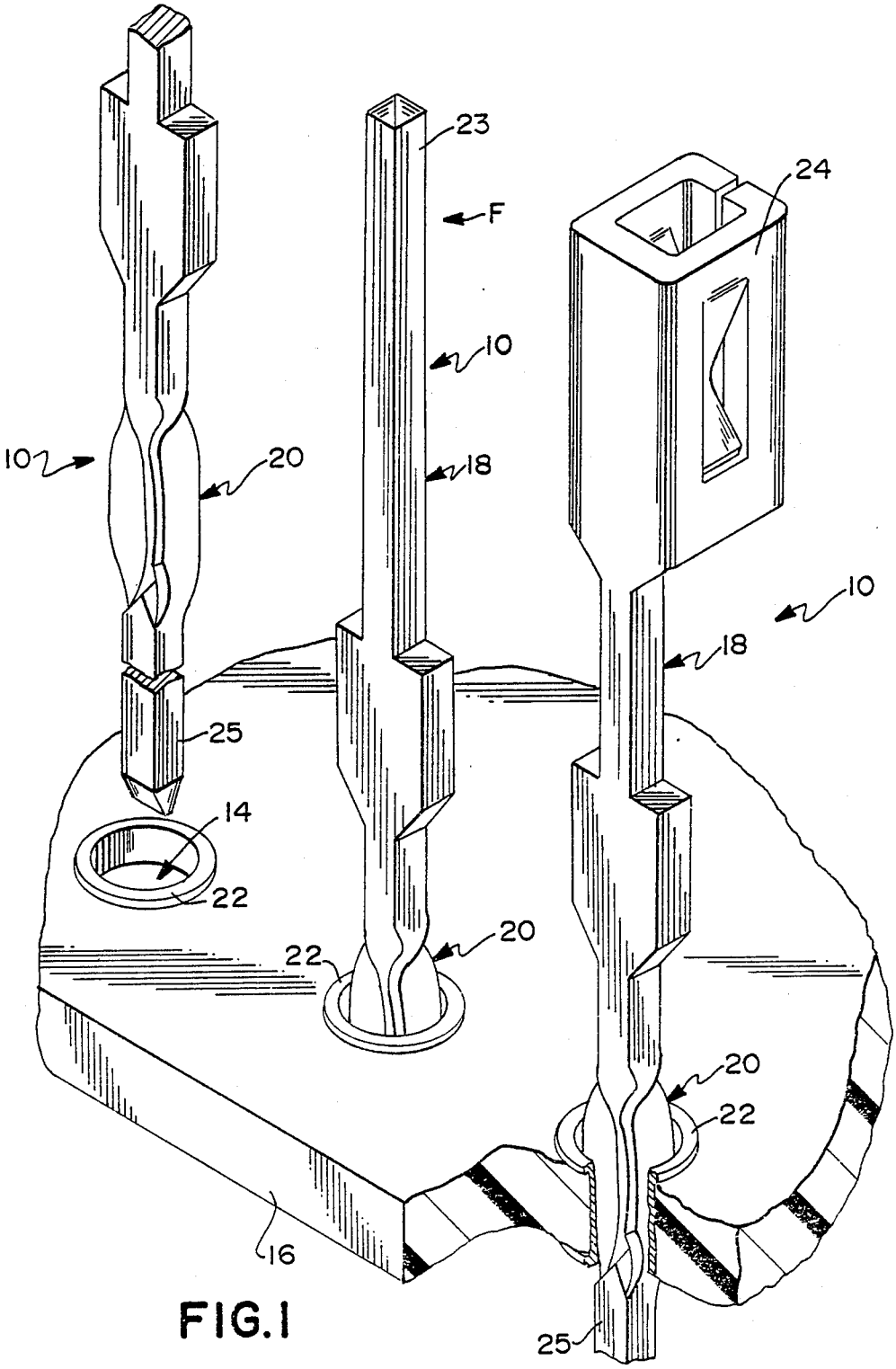
FIG. 1 is an enlarged, partially exploded, partially sectioned, fragmentary view of a printed circuit board having several plated-through holes showing the application of the terminal pin of the present invention.

Turning now to the drawings in greater detail, the invention is seen to be a generally elongated electrical terminal pin, generally designated 10, which is adapted to be inserted into a plated throughhole 14 formed in a printed circuit board 16. This is best shown in FIG. 1.

The pin 10 includes a mating portion 18 which is adapted to contact an electrically conductive element (not shown) and a compliant portion, generally designated 20, which extends from the mating portion 18 downwardly. The compliant portion 20 is adapted to make electrical contact with the conductive plating material 22 which defines the interior surface of the plated through-hole 14.

The mating portion 18 of each pin 10 can be in a number of configurations. FIG. 1 shows a mating portion 18 in the form of a male pin 23 which is adapted to mate with a conventional female contact (not shown). Also shown in FIG. 1 is a mating portion 18 in the form of a conventional female contact 24 which is adapted to mate with a male pin (not shown).

The pin 10, as shown, includes a second or lower mating portion 25 in the form of a pin or post depending from the compliant portion 20. In this configuration, a female connector or wire wrap can be applied to the depending post 25.

Looking at the compliant portion 20 in greater detail, it is seen to include, in the axial direction, a tapered lead in or transition section, the extent of which is designated by the letter "T". The transition section "T" extends from a first axial end of the compliant portion 20 towards a contact section, generally designated by "C" in FIGS. 2 and 3. The contact section "C" defines the axial extent of electrical and mechanical contact that the compliant portion 20 has with the interior surface 22 of the plated through-hole 14.

The transition section "T" may initially engage the top of the plated through-hole 14. However, when the compliant portion 20 is fully inserted, only the contact section "C" engages the interior surface 22 of hole 14.

Figure 4:
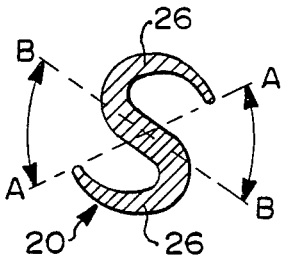
FIG. 4 is a sectional view of the compliant portion of the terminal of the present invention in a relaxed position.
Figure 5:
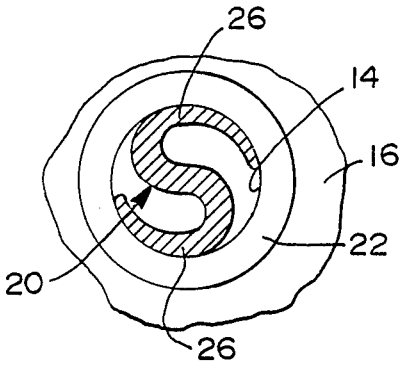
FIG. 5 is a sectional view of the compliant portion of the terminal pin of the present invention inserted in a plated-through hole.

Looking at FIGS. 4 and 5, the lateral cross section of the compliant portion 20 is seen to be generally S-shaped. The S-shaped cross-section includes a pair of oppositely directed generally C-shaped arms 26. Each arm 26 is joined to the other at one end defining the center of the cross-section. The opposite end of each arm 26 is free to flex inwardly toward the center when inward forces or pressure is applied as shown in FIG. 5. The resiliency is enhanced because the thickness of each arm 26 is tapered from the joined end towards the free end due to chamfering. The taper S cross-section extends throughout the entire compliant portion 20, i.e., from the contact section "C" through the transition section "T". This gives each arm 26 more compliancy at its free end.

Because it is desirable to have a large amount of the contact section "C" engaging the interior surface 22 of the plated throughhole 14, each "C" arm 26 should curve around as much as practicable. To this end, as is best shown in FIG. 4, a radial line, designated A—A, passing through the free end of each arm 26 in the center of the cross-section generally forms a forty-five degree angle with a line, designated B—B, going through the center of the cross-section at the joined ends of both arms. If the angle thus defined is much greater than forty-five degrees, the contact section "C" will be too stiff and create undesireably large insertion forces. On the other hand, if the angle defined above is much less than forty-five degrees, the contact section "C" becomes too resilient and, more significantly, the pin 10 becomes more difficult to manufacture due to unmanageable tolerances.

Figure 2:
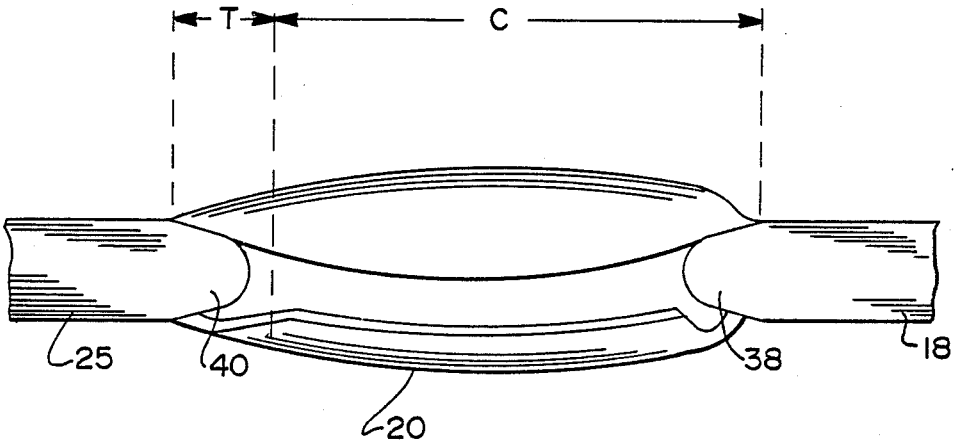
FIG. 2 is a side view of the compliant portion of the terminal pin of the present invention
Figure 3:
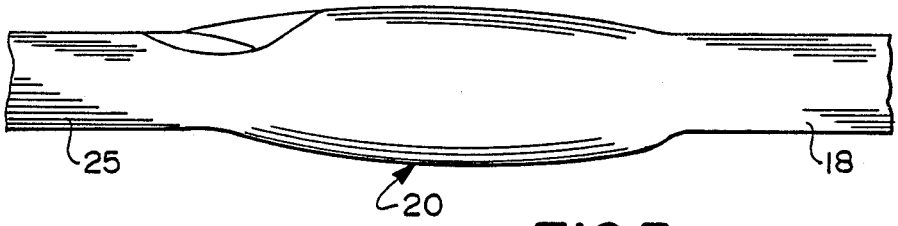
FIG. 3 is a side view of the compliant portion of the terminal pin of the present invention rotated 90 degrees about its axis relative to the view shown in FIG. 2.

As best can be seen in FIGS. 2 and 3, and contact section "C" of the compliant portion 20 has a width that gradually increases from the end of the transition section "T" towards at least the middle of the axial length of the contact section "C". This specific design, which has heretofore been unknown, compensates for the plastic deformation caused during insertion of the pin 10 into the hole 18. (See the Goel Article.) That is, when the compliant portion 20 is fully inserted into a hole 14, it can accommodate a certain amount of deformation due to the increased width at the point of the contact section "C" where the greatest normal force against the interior surface 22 of the hole 14 is desired.

Frequently, pins 10 may be damaged when or after they are inserted into a hole 14. This may be caused by a force, designated "F" in FIG. 1, transversely applied to the mating portion 18. If the force "F" is great enough, the mating portion 18 will bend relative to the circuit board 16 and may break off at its juncture with the compliant portion 20. It is, therefore, desireable to provide means to resist bending or twisting damage. To this end, there is provided a stiffening projection 38 extending downwardly from the mating portion 18 onto at least one surface of the compliant portion 20. As is best seen in FIG. 3, the stiffening projection 38 is in the form of a tapered relief.

A second stiffening projection 40 is formed on the transition section "T" extending from the second or lower mating portion 25. This prevents breakage from the compliant portion 20 should a transverse force be applied to the second mating portion 25.

In order to mass produce the pin 10 of the present invention, there is provided an elongate strip of material 42 having usual pilot holes 44 along at least one edge thereof. The strip of material 42 has a width from edge to edge equal to or greater than the length of the pin 10. The thickness of the strip of material 42 which is defined between oppositely facing first and second surfaces, 48 and 50, respectively, is equal to the thickness required for the material to make the mating portion 18.

Figure 6:
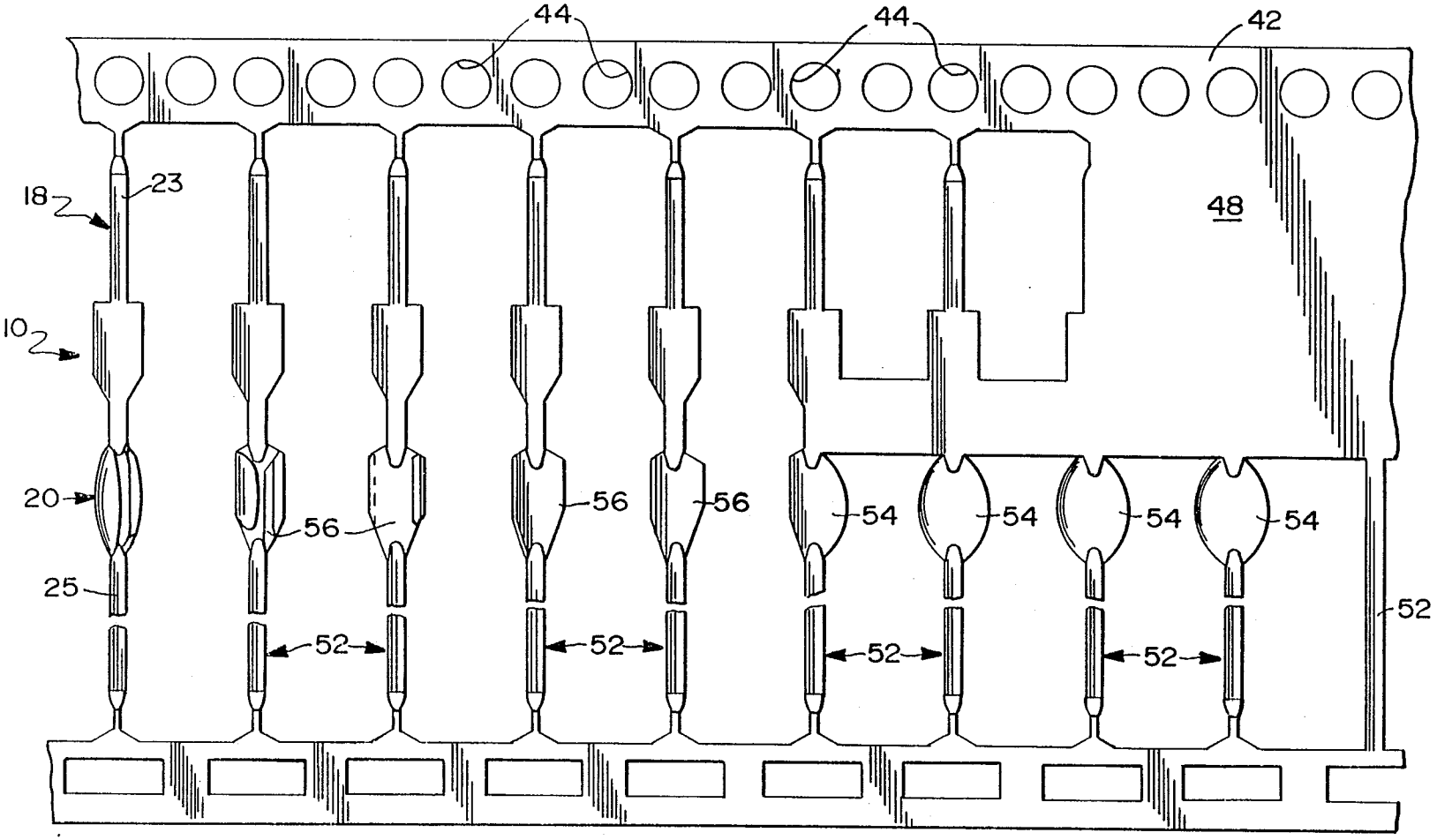
FIG. 6 is a plan view of a strip of material showing the process of manufacture of the terminal pin of the present invention.

As shown in FIG. 6, the mating portion 18 is in the form of a male pin 23 or post. If the pin is an 0.025 square wire pin, then the thickness of the strip of material 42 should be 0.025 inch. Likewise, if a female contact (24 in FIG. 1) is being formed for the mating portion 18, then the thickness of the strip of material 42 would be the same thickness required to form said female contact, e.g., 0.011 inch.

The strip of material 42 is then stamped transversely along its length to form a plurality of parallel, spaced-apart terminal blanks 52. The blank 52 is then coined at a portion whose axial length coincides with the compliant portion 20. During the coining operation, the thickness of the material is made thinner relative to the original thickness resulting in a flattened section 54. Specifically, the flattened section is reduced from 0.025 inch thick to 0.011 inch thick. It is important to note that if the strip of material is initially 0.011 inch thick because a female contact 24 is being formed, it is not necessary to coin in order to form flattened section 54. It is already 0.011 inch thick.

Stiffening projections 38 and 40 are formed on at least the first surface 48 of the strip of material 42. The flattened section 54 is the stamped or trimmed to form a region having two oppositely extending, generally tapered trapezoidal wings 56.

Figure 7:
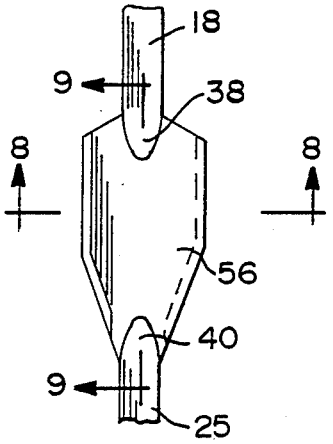
FIG. 7 is a fragmentary plan view showing the compliant portion of the terminal pin of the present invention before it is formed into an S-shaped cross-section.
Figure 8:
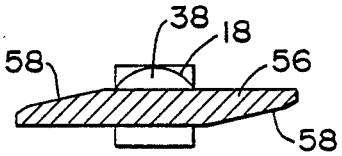
FIG. 8 is a sectional view taken generally along the line 8—8 of FIG. 7.
Figure 9:
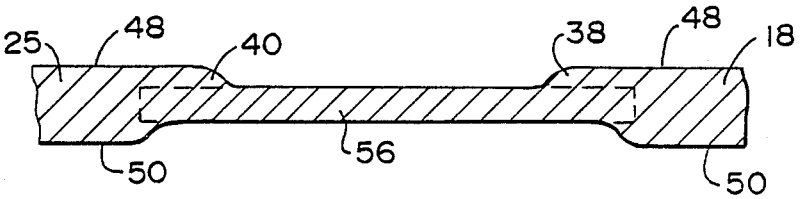
FIG. 9 is a sectional view taken generally along the line 9—9 of FIG. 7.

A secondary coining operation produces a chamfer at the end 58 of each wing 56. This produces the structure that is best seen in FIGS. 7, 8 and 9. The trapezoidal wings 56 are then formed at successive stations so that it assumes the configuration of the S-shaped cross-sectioned compliant portion 20.

The mating portion 18 is also formed at successive stations. If the mating portion 18 is a male pin 23, then it is a simple matter to stamp the material between adjacent pins 10. If, on the other hand, the mating portion 18 assumes the configuration of a female contact (24 in FIG. 1), then such a configuration can be formed in a conventional manner (not shown).

Because of the method fo manufacture described above, the pin 10 of the present invention can be mass produced by using conventional stamping and forming processes. In addition, the steps of the process can be achieved by starting out with a strip of material 42 of the same thickness. In the past, if it were desired to produce a compliant pin of the type described with a female contact, the female portion would have to be made as a separate piece from the compliant portion and mechanically attached, e.g. by welding, after forming. However, with the method of the present invention, a compliant pin 10 having a female contact as the mating portion 18 can be manufactured integrally from one strip of material 42.

We claim:

1. A generally elongated electrical terminal pin adapted to be inserted into a plated-through hole in a circuit board, said pin including a mating portion adapted to contact an electrically conductive element and a compliant portion extending from said mating portion adapted to make electrical contact with conductive plating material defining the interior surface of said plated-through hole, said compliant portion including, in the axial direction, a transition section tapering from a first axial end to a fully developed contact section defining the axial extent of contact with the interior surface of the plated-through hole, said compliant portion further including, in the lateral direction, a generally S-shaped cross-section, the improvement in said compliant portion comprising:

said S-shaped contact section having a width that varies throughout substantially all of the length of the contact section and that gradually increases from the transition section toward at least the middle of the axial length of the contact section.

2. The pin of claim 1 wherein the mating portion is a male terminal adapted to be received within a female terminal of said conductive element.

3. The pin of claim 1 wherein the mating portion is a female terminal adapted to receive a male terminal of said conductive element.

4. The pin of claim 1 wherein said S-shaped cross-section includes a pair of oppositely directed generally C-shaped arms, each arm being joined to the other at one end defining the center of the cross-section and free at the other end, the thickness of each arm is gradually tapered from the joined end toward the free end so that the thickness at the center of the cross-section is greater than the thickness of the arms at any point going toward the free ends thereof whereby each arm is more compliant at the free end thereof.

5. The pin of claim 4 wherein the free ends of each arm are chamfered.

6. The pin of claim 4 wherein a radial line passing through the free end of each arm and the center of the cross-section generally forms a forty-five degree angle with the centerline of the cross-section at the joined ends of both arms.

7. A generally elongated electrical terminal pin adapted to be inserted into a hole in a circuit board, said pin including a mating portion adapted to contact an electrically conductive element and a hole engaging portion extending from said mating portion adapted to be received within said hole, the thickness of the material defining the mating portion being greater than the thickness of the material defining the hole engaging portion, the improvement in said pin comprising:

stiffening means formed on one side of the hole engaging portion extending from the mating portion onto the hole engaging portion defining a thickened section thereon to prevent breaking of the mating portion from the hole engaging portion when a bending movement is applied to the mating portion, said thickened section having a thickness larger than the thickness of the remainder of the hole engaging portion.

8. The pin of claim 7 wherein said stiffening means includes a tapered relief extending from the mating portion.

9. The pin of claim 7 wherein said hole engaging portion is a compliant portion adapted to make electrical contact with conductive plating material defining the interior surface of said plated-through hole and including, in the axial direction, a contact section defining the axial extent of contact with the interior surface of the plated-through hole.

10. The pin of claim 9 including a second mating portion extending from the end of the compliant portion opposite the first mating portion and extending below the circuit board when the compliant portion is in the hole, said compliant portion further including a transition section tapering between said second mating portion and the contact section, said pin including second stiffening means formed on one side of the transition section extending from the juncture with the second mating portion.

11. A method of manufacturing spaced-apart, parallel, elongated electrical terminal pins, each pin including a mating portion joining an S-shaped compliant portion, said method comprising the steps of:

providing an elongate strip of material having a width equal to or greater than the length of the pin and a first uniform thickness defined between oppositely facing first and second surfaces equal to the thickness required for the mating portion;

stamping the strip transversely along the length to form a plurality of parallel, spaced-apart terminal blanks;

stamping the blank to form a section at the location of the compliant portion equal to the axial length thereof including two oppositely extending, generally tapered trapezoidal wings; and forming the wings into a generally S-shaped cross-sectional compliant portion.

12. The method of claim 11 wherein said mating portion is a female contact, said strip of materially being generally of the same thickness as the stamped section, said method further including the steps of stamping and forming the female mating portion.

13. The method of claim 11 wherein said mating portion is a male contact, said strip of material having a thickness greater than the stamped section, said method further including the step of coining material from the terminal blank at the stamped section to define a flattened section of a second thinner thickness than the thickness of the strip of material.

14. The method of claim 11 wherein the opposite free ends of the wings are coined to produce a chamfer thereat.

15. The method of claim 14 wherein said coining step provides a stiffening relief extending from and axially aligned with the mating portion onto a portion of the stamped section bisecting the wings.

* * * * *